United States Patent [19]

Ishizaki et al.

[11] Patent Number: 4,491,455

[45] Date of Patent: Jan. 1, 1985

[54] METHOD FOR IMPROVING COLD FLOW OF FUEL OILS

[75] Inventors: Takaharu Ishizaki, Nishinomiya; Takeshi Nagai; Shingo Yamazaki, both of Amagasaki, all of Japan

[73] Assignee: Nippon Oil and Fats Co., Ltd., Tokyo, Japan

[21] Appl. No.: 420,647

[22] Filed: Sep. 21, 1982

[30] Foreign Application Priority Data

Feb. 10, 1982 [JP] Japan ..... 57-18974

[51] Int. Cl.[3] ..... C10L 1/22

[52] U.S. Cl. ..... 44/62; 44/66; 44/71

[58] Field of Search ..... 44/62, 66, 71

[56] References Cited

U.S. PATENT DOCUMENTS

| | | | |
|---|---|---|---|
| 2,839,372 | 6/1958 | Lindstrom et al. | 44/66 |
| 3,272,746 | 9/1966 | LeSuer et al. | 44/71 |
| 3,275,427 | 9/1966 | Brownawell et al. | 44/62 |
| 3,405,064 | 10/1968 | Miller | 44/71 |
| 3,658,493 | 4/1972 | Hollyday, Jr. | 44/71 |
| 3,661,541 | 5/1972 | Hollyday, Jr. | 44/62 |
| 3,844,731 | 10/1974 | Biasotti et al. | 44/71 |
| 3,883,318 | 5/1975 | Feldman et al. | 44/62 |
| 3,982,909 | 9/1976 | Hollyday, Jr. | 44/66 |
| 4,153,423 | 5/1979 | Wisotsky | 44/62 |
| 4,210,424 | 7/1980 | Feldman et al. | 44/66 |

*Primary Examiner*—Mrs. Y. Harris-Smith

*Attorney, Agent, or Firm*—Parkhurst & Oliff

[57] ABSTRACT

The cold flow of fuel oils is improved by adding esters of nitrogen-containing compounds having polyhydroxyl groups with linear saturated fatty acids or a combination of said esters and polymers of one or more monomers selected from the group consisting of olefins, alkyl esters of ethylenically unsaturated carboxylic acids and vinyl esters of saturated fatty acids to fuel oils.

11 Claims, No Drawings

METHOD FOR IMPROVING COLD FLOW OF FUEL OILS

BACKGROUND OF THE INVENTION

1. Field of the Invention

The present invention relates to a method for improving the cold flow of hydrocarbon fuel oils.

2. Description of the Prior Art

Since the oil crisis, a variety of sources for fuel oils have been used and a ratio of amount of light crude oils has been reduced and therefore it is supposed that the use of heavy crude oils is in future more increased. On the other hand, the demand of middle distillate fuel oils tends to be increased in view of the regulation of exhaust of sulfur oxides. Therefore, if it is intended to obtain fuel oils as much as possible from heavy crude oils containing a large amount of paraffins having high molecular weight through fractional distillation, it is necessary to take out the distillate to fraction of high boiling points. As the result, the paraffin content having high molecular weight is increased in the distilled fuel oils.

In such fuel oils, crystals of paraffin are more apt to be precipitated and grown at a low temperature than in conventional fuel oils and the fluidity lowers. Furthermore, large paraffin crystal grains are formed even at a temperature at which the fluidity is maintained and a filter in the fuel supply stream and piping in diesel engine, etc. are plugged and the flowing of fuel oils is inhibited.

For solving these problems, a large number of cold flow improvers of fuel oils have been proposed, for example, condensation products of chlorinated paraffin and naphthalene (U.S. Pat. No.1,815,022), polyacrylates (U.S. Pat. No. 2,604,453), polyethylenes (U.S. Pat. No. 3,474,157), copolymers of ethylene and propylene (French Pat. No. 1,438,656) and copolymers of ethylene and vinyl acetate (U.S. Pat. No. 3,048,479) and the like.

When these cold flow improvers are added to fuel oils, they show excellent ability to lowering the pour point in a pour point test (JIS K 2269) but in many cases these cold flow improvers have substantially no effect in a cold filter plugging point test (abbreviated as CFPP hereinafter) by which the plugging of the filter in the fuel supply system at low temperatures is judged. The improvers that are effective with fuel oils containing a large amount of paraffin having high molecular weight, are few in number.

The pour point test cannot forecast the plugging of the filter in the fuel supply system due to paraffin crystal grains formed at a fairly higher temperature than the pouring point but the CFPP test serves to forecast this phenomenon and at present is widely used.

SUMMARY OF THE INVENTION

The inventors have made diligent studies and found that when specific esters are added to fuel oils, the CFPP is greatly lowered and that when specific polymers are used together with said esters, the pour point is greatly lowered together with CFPP.

That is, the present invention lies in a method for improving cold flow of fuel oils, which comprises adding linear saturated fatty acid esters of nitrogen-containing compounds having polyhydroxyl groups to fuel oils, and more particularly a method for improving cold flow of fuel oils, which comprises adding linear saturated fatty acid esters of nitrogen-containing compounds having polyhydroxyl groups and polymers of at least one monomer selected from the group consisting of olefins, alkyl esters of ethylenically unsaturated carboxylic acids and vinyl esters of saturated fatty acids.

DESCRIPTION OF THE PREFERRED EMBODIMENT

As nitrogen-containing compounds having hydroxyl groups to form the esters, the compounds having 2–10 hydroxyl groups are preferable, for example, diethanolamine, methyldiethanolamine, ethyldiethanolamine, butyldiethanolamine, diisopropanolamine, methyldiisopropanolamine, ethyldiisopropanolamine, butyldiisopropanolamine, triethanolamine, triisopropanolamine, dimethylmono(dihydroxypropyl)amine, dibutylmono(dihydroxypropyl)amine, diethanolmono(dihydroxypropyl)amine, ethanolbis(dihydroxypropyl)amine, tris(dihydroxypropyl)amine, or addition products of epoxides, such as ethylene oxide, propylene oxide, butylene oxide or glycidol of polyamines, such as ethylenediamine, propylenediamine, hexamethylenediamine, xylylenediamine, diethylenetriamine, triethylenetetramine, etc., diethanolamide, diisopropanolamide of fatty acids, such as lauric acid, myristic acid, palmitic acid, stearic acid, behenic acid, etc.

Linear saturated fatty acids to form the esters include fatty acids having 12–30 carbon atoms, for example, lauric acid, myristic acid, palmitic acid, stearic acid, arachic acid, behenic acid, lignoceric acid, melissic acid and the like and coconut oil fatty acids, hydrogenated beef tallow fatty acids, hydrogenated rapeseed oil fatty acids, hydrogenated fish oil fatty acids containing these fatty acids and the like may be used.

The esters to be used in the present invention can be obtained by esterifying the above described nitrogen-containing compounds having polyhydroxyl groups and the above described fatty acids in a usual manner.

The olefins to form the polymers are olefins having 2–30 carbon atoms and particularly $\alpha$-olefins are preferable and they are, for example, ethylene, propylene, 1-butene, isobutene, 1-pentene, 1-hexene, 1-heptene, 1-octene, diisobutene, 1-dodecene, 1-octadecene, 1-eicosene, 1-tetracosene, 1-triacontene, etc.

Alkyl esters of ethylenically unsaturated carboxylic acids to form the polymers are esters of unsaturated carboxylic acids, such as acrylic acid, methacrylic acid, itaconic acid, crotonic acid, maleic acid, fumaric acid, etc. and saturated alcohols having 1–30 carbon atoms, such as methyl alcohol, ethyl alcohol, n-propyl alcohol, isopropyl alcohol, n-butyl alcohol, isobutyl alcohol, isoamyl alcohol, n-hexyl alcohol, 2-ethylhexyl alcohol, n-octyl alcohol, n-decyl alcohol, lauryl alcohol, myristyl alcohol, cetyl alcohol, stearyl alcohol, behenyl alcohol, 3-methylpentadecyl alcohol, tricosyl alcohol, pentacosyl alcohol and oxo alcohols.

Saturated fatty acid vinyls to form the polymers are vinyl esters of saturated fatty acids having 1–30 carbon atoms, for example, vinyl formate, vinyl acetate, vinyl propionate, vinyl butyrate, vinyl hexanoate, vinyl octanoate, vinyl decanoate, vinyl laurate, vinyl myristate, vinyl palmitate, vinyl stearate, vinyl behenate, vinyl lignocerate, vinyl melissate, etc.

The polymers to be used in the present invention are obtained by polymerizing one or a mixture of two or more of the above described monomers in a usual manner or by esterifying the polymers of ethylenically unsaturated carboxylic acids with alcohols. The number average molecular weight of the polymers is preferred to be 500–50,000.

In the present invention, when it is intended mainly to lower CFPP, this object can be attained by adding the above described esters to fuel oils.

When it is intended to lower both CFPP and the pour point, this object can be attained by adding the above described esters and the above described polymers to fuel oils. The mixture ratio of the esters to the polymers is 1:9–9:1 (weight ratio) in order to effectively lower both CFPP and the pour point.

A total amount of the esters, or the esters and the polymers added to fuel oils according to the present invention is 10–5,000 ppm by weight, preferably 50–1,000 ppm and in less than 10 ppm, the satisfactory effect cannot be obtained and even if the amount exceeds 5,000 ppm, the effect is not improved and such an amount is not economically advantageous.

In the present invention, antioxidants, corrosion preventing agents, other cold flow improvers, which are generally added to fuel oils, may be used together.

The present invention can greatly lower CFPP and the pour point of fuel oils, so that various problems regarding the cold flow in storage and transport of distillate fuel oils having a relatively high boiling point, which contain paraffin of high molecular weight, can be solved. The fuel oils are usable even to fractions of high boiling points.

The present invention will be explained in more detail.

The following examples are given for the purpose of illustration of this invention and are not intended as limitations thereof.

EXAMPLE

An example for preparing triethanolamine triester of behenic acid to be used in this example is shown and the other esters can be prepared in the same manner as in this example.

1,035 g (3.0 mole) of behenic acid (acid value 162.6) and 149 g (1.0 mole) of triethanolamine (first grade reagent) were reacted at a temperature of 160°–180° C. for 6 hours under nitrogen atmosphere to complete the esterification reaction while removing distilled water. The product had an acid value of 5.2 and a hydroxyl value of 3.5.

Explanation will be made with respect to polymers to be used in this example hereinafter.

Polymer 1 is a copolymer of ethylene and vinyl acetate, ACP-430 (made by Allied Chemical Co., United States of America, number average molecular weight: 3,500, ratio of vinyl acetate: 29% by weight).

Polymer 2 is the following product. A mixture of 47 g of a copolymer of ethylene and acrylic acid, ACP-5120 (made by Allied Chemical Co., United States of America, number average molecular weight: 3,500, acidic value: 120), 45 g of lauryl alcohol, 0.2 g of paratoluene sulfonic acid and 100 g of xylene was subjected to esterification reaction for 10 hours by circulating xylene under nitrogen atmosphere while distilling off water and the reaction mass was gradually introduced into an excess amount of methanol and the precipitate was filtered off and dried.

Polymer 3 was prepared as follows. While heating a mixture of 339 g (1.0 mole) of α-olefin having 20–28 carbon atoms, 98 g (1.0 mole) of maleic anhydride and 500 g of xylene under nitrogen atmosphere so as to circulate xylene, a solution of 4 g of di-t-butyl peroxide dissolved in 50 g of xylene was gradually added thereto and the polymerization reaction was continued for 10 hours under this condition and then 273 g (2.1 mole) of 2-ethylhexyl alcohol and 2 g of paratoluenesulfonic acid were added thereto and the esterification reaction was effected for 10 hours and then xylene was distilled off.

Polymer 4 is branched polyethylene, ACP-1702 (made by Allied Chemical Co., United States of America, number average molecular weight: 1,100, specific gravity: 0.88).

Polymer 5 is polyalkyl methacrylate, Acryloid 152 (made by Rohm and Haas Company, number average molecular weight: 17,000, carbon atom in alkyl group: 12–20).

Pour points and CFPP of heavy gas oil fraction having the following properties are shown in the following Table 1. Heavy gas oil fraction which has been produced from the Middle East crude oil and has a slightly high boiling point and a narrow boiling point range, to which the esters and the polymers can be added can be used in the present invention.

| Properties of heavy gas oil fraction: | | |
|---|---|---|
| (1) | Boiling point range | |
| | Initial boiling point | 227° C. |
| | 20% distilled point | 290° C. |
| | 90% distilled point | 343° C. |
| | End point | 360° C. |
| (2) | Pour point | −2.5° C. |
| (3) | CFPP | 0° C. |

TABLE 1

| | No. | Additive | Addition amount (ppm) | CFPP*1 (°C.) | Pour*2 point (°C.) |
|---|---|---|---|---|---|
| Present invention | 1 | Diethanolmono(dihydroxypropyl)amine triester of behenic acid | 300 | −11 | −5 |
| | 2 | Triethanolamine diester of hydrogenated rapeseed oil fatty acids | 500 | −7 | −5 |
| | 3 | Triethanolamine triester of behenic acid | 500 | −11 | −5 |
| | 4 | Tetrahydroxyethylethylenediamine triester of synthetic fatty acids*3 | 500 | −7 | −2.5 |
| | 5 | Behenoildiethanolamide diester of behenic acid | 400 | −8 | −2.5 |
| | 6 | Triethanolamine triester of mixed fatty acids*4 | 500 | −10 | −5 |
| | 7 | Diisopropanolmonoethanolamine triester of mixed fatty acids | 500 | −6 | −7.5 |
| | 8 | Diethanolmono(dihydroxypropyl)amine triester of behenic acid + Polymer 1 | 200<br>100 | −12 | −12.5 |
| | 9 | Triethanolamine diester of hydrogenated | 250 | −8 | −15 |

TABLE 1-continued

| | No. | Additive | Addition amount (ppm) | CFPP*1 (°C.) | Pour*2 point (°C.) |
|---|---|---|---|---|---|
| | | rapeseed oil fatty acids + | | | |
| | | Polymer 2 | 250 | | |
| | 10 | Triethanolamine triester of behenic acid + | 300 | −10 | −15 |
| | | Polymer 3 | 200 | | |
| | 11 | Tetrahydroxyethylethylenediamine triester of synthetic fatty acids*3 + | 200 | −8 | −10 |
| | | Polymer 4 | 300 | | |
| | 12 | Behenoildiethanolamide diester of behenic acid + | 200 | −9 | −12.5 |
| | | Polymer 5 | 200 | | |
| | 13 | Triethanolamine triester of mixed fatty acids*4 + | 200 | −10 | −12.5 |
| | | Polymer 1 | 100 | | |
| | 14 | Diisopropanolmonoethanolamine triester of mixed fatty acids*5 + | 400 | −6 | −15 |
| | | Polymer 2 | 100 | | |
| Comparative Example | 15 | Polymer 1 | 300 | 2 | −12.5 |
| | 16 | Polymer 2 | 500 | 1 | −12.5 |
| | 17 | Polymer 3 | 500 | −1 | −10 |
| | 18 | Polymer 4 | 500 | 3 | −10 |
| | 19 | Polymer 5 | 400 | 0 | −12.5 |

Note:
*1Measured following to IP 309/76.
*2Measured following to JIS K 2269-1980.
*3Synthetic fatty acid: mixed fatty acids having 21-29 carbon atoms, acid value: 140, iodine value: 2, melting point: 63° C.
*4Mixed fatty acids: 70 mol % of behenic acid and 30 mol % of naphthenic acid.
*5Mixed fatty acids: 80 mol % of stearic acid and 20 mol % of adipic acid.

As seen from Table 1, the cases (No. 1-No. 7) where the esters are used alone, are low in CFPP, the cases (No. 8-No. 14) where the combination of the ester and the polymer is used, are low in both CFPP and the pour point. The cases (No. 15-No. 19) where the polymers are used alone, do not become too low in CFPP but are low in the pour point.

What is claimed is:

1. A method for improving the cold flow of fuel oils comprising adding esters of nitrogen-containing compounds having polyhydroxyl groups with 2-10 hydroxyl groups, and linear saturated fatty acids having 12-30 carbon atoms to fuel oils.

2. A method for improving the cold flow of fuel oils comprising adding esters of nitrogen-containing compounds having polyhydroxyl groups having 2-10 hydroxyl groups, and linear saturated fatty acids to fuel oils.

3. A method for improving the cold flow of fuel oils comprising adding esters of nitrogen-containing compounds having polyhydroxyl groups and linear saturated fatty acids having 12-30 carbon atoms to fuel oils.

4. The method of claim 1 further comprising adding polymers of at least one monomer selected from the group consisting of: olefins having 2-30 carbon atoms, alkyl esters of ethylenically unsaturated carboxylic acids and vinyl esters of saturated fatty acids to said fuel oils.

5. A method as claimed in claim 4, wherein said alkyl esters of ethylenically unsaturated carboxylic acids are esters of ethylenically unsaturated carboxylic acids and saturated alcohols having 1-30 carbon atoms.

6. A method as claimed in claim 4, wherein said vinyl esters of saturated fatty acids are vinyl esters of saturated fatty acids having 1-30 carbon atoms.

7. A method for improving the cold flow of fuel oils according to claim 1 wherein said nitrogen-containing compound having polyhydroxyl groups is selected from the group consisting of: diethanolamine, methyldiethanolamine, ethyldiethanolamine, butyldiethanolamine, diisopropanolamine, methyldiisopropanolamine, ethyldiisopropanolamine, butyldiisopropanolamine, triethanolamine, triisopropanolamine, dimethylmono(dihydroxypropyl)amine, dibutylmono(dihydroxypropyl)amine, diethanolmono(dihydroxypropyl)amine, ethanolbis(dihydroxypropyl)amine, and tris(dihydroxypropyl-)amine.

8. A method for improving the cold flow of fuel oils according to claim 1 wherein said linear saturated fatty acid is selected from the group consisting of: lauric acid, myristic acid, palmitic acid, stearic acid, arachic acid, behanic acid, lignoceric acid, melissic acid, coconut oil fatty acids, hydrogenated beef tallow fatty acids, hydrogenated rapeseed oil fatty acids, and hydrogenated fish oil fatty acids.

9. A method for improving the cold flow of fuel oils according to claim 4 wherein said olefin is selected from the group consisting of: ethylene, propylene, 1-butene, isobutene, 1-pentene, 1-hexene, 1-heptene, 1-octene, diisobutene, 1-dodecene, 1-octadecene, 1-eicosene, 1-tetracosene, and 1-triacontene.

10. A method for improving the cold flow of fuel oils according to claim 1 wherein said nitrogen-containing compound having polyhydroxyl groups is an addition product of (a) an epoxide selected from the group consisting of: ethylene oxide, propylene oxide, butylene oxide and glycidol; and (b) a polyamine selected from the group consisting of: ethylenediamine, propylenediamine, hexamethylenediamine, xylylenediamine, diethylenetriamine, and triethylenetetramine.

11. A method for improving the cold flow of fuel oils according to claim 1 wherein said nitrogen-containing compound having polyhydroxyl groups is an amide of (a) an amine selected from the group consisting of: diethanolamine and diisopropanolamine; and (b) a fatty acid selected from the group consisting of: lauric acid, myristic acid, palmitic acid, stearic acid, and behenic acid.

* * * * *